United States Patent [19]

Walega

[11] Patent Number: 4,709,433

[45] Date of Patent: Dec. 1, 1987

[54] HEEL MOLDER FLANGER

[75] Inventor: William Walega, Hollis, N.H.

[73] Assignee: International Shoe Machine Corporation, Nashua, N.H.

[21] Appl. No.: 848,174

[22] Filed: Apr. 4, 1986

[51] Int. Cl.[4] ..... A43D 21/00; A43D 11/12; A43D 21/12

[52] U.S. Cl. ..... 12/12.5; 12/54.3; 12/8.2

[58] Field of Search ..... 12/10.5, 10.8, 11.3, 12/12.5, 14.4, 54.1, 54.3, 54.4, 54.6, 12.3, 8.2, 12

[56] References Cited

U.S. PATENT DOCUMENTS

| | | | |
|---|---|---|---|
| 2,983,934 | 5/1961 | Bertrand | 12/54.3 |
| 3,228,046 | 1/1966 | Kamborian et al. | 12/10.5 |
| 3,307,210 | 3/1967 | Lauretti | 12/8.2 |
| 3,328,815 | 7/1967 | Forma | 12/8.2 |
| 4,150,454 | 4/1979 | Becka | 12/12.5 |
| 4,224,708 | 9/1980 | Becka | 12/54.4 |
| 4,266,313 | 1/1980 | Vornberger | 12/54.3 |
| 4,338,696 | 7/1982 | Bichet | 12/54.3 |
| 4,400,839 | 8/1983 | Hartshorn et al. | 12/12.5 |
| 4,422,198 | 12/1983 | Bichet | 12/53.5 |

FOREIGN PATENT DOCUMENTS

| | | | |
|---|---|---|---|
| 2464662 | 4/1981 | France | 12/54.3 |

OTHER PUBLICATIONS

"Heel Molder Flanger", Bulletin Model D (HMF-D) 5/82.

"Heel Molder Flangers", Bulletin Models D, G and E, 5/82.

*Primary Examiner*—Werner H. Schroeder
*Assistant Examiner*—Steven N. Meyers
*Attorney, Agent, or Firm*—Robert Shaw

[57] ABSTRACT

A machine to mold and flange the heel region of an upper whose heel region has been heated to soften the same. The heel region includes a thermal plastic material which softens when heated and is fairly rigid at and below room temperature. The machine includes a mold to receive the heated upper, the mold being cooled to reduce the temperature of the upper during the molding or forming operation. The machine further includes pincers to draw or stretch the upper about the mold, the direction of stretch being variable, a pad to wrap about the heel region of the upper and wipers. An equalizer mechanism centers the pad with respect to the mold to equalize pressure and the pad has a quick change mechanism associated therewith, as do the wipers. A height gage is provided to assure proper heightwise positioning of the upper on the mold.

18 Claims, 14 Drawing Figures

HEEL MOLDER FLANGER

The present invention relates to machines to mold and flange the heel of a shoe or other footwear upper.

There is in the file of this case a bulletin of International Shoe Machine Corporation describing heel molder flangers. Briefly, such a machine receives an upper having a thermoplastic counter which has been heat softened on a heated activator mold. The upper is placed on a cooled forming mold and then shaped and cooled. The shaping is achieved through stretching or drawing the heel portion of the heated upper about the cooled mold, using pincers that grasp the toe of the upper and pull it longitudinally, and wiping the margin of the upper to flange the heel portion of the upper. Examples of the formed upper are shown in the bulletin.

It is an object of the present invention to provide a machine to mold and flange the heel of a shoe or other footwear upper.

This and still further objects are addressed hereinafter.

The foregoing objects are achieved, generally, in a machine to mold and flange the heel of an upper whose heel region has been heated to soften the same, that includes a mold to receive the upper and adapted to cool the heel region of the upper; a pincers mechanism operable to grasp the upper and draw it longitudinally to stretch it and form the heel portion of the upper to the exterior shape of the back of the mold, the pincers mechanism including a drive that serves to move the pincers to draw or stretch the upper longitudinally; a pad having an interior contour shaped to the exterior shape of the back region of the mold; and a pad drive to move the pad from a position spaced from the mold to a position in intimate contact with the heel portion of the upper to squeeze the mold, which pad drive includes an equalizer mechanism whereby the pad adjusts in order to apply substantially uniform inward pressure at all points between the pad and the mold.

The invention is hereinafter described with reference to the accompanying drawing in which.

Figure 1:
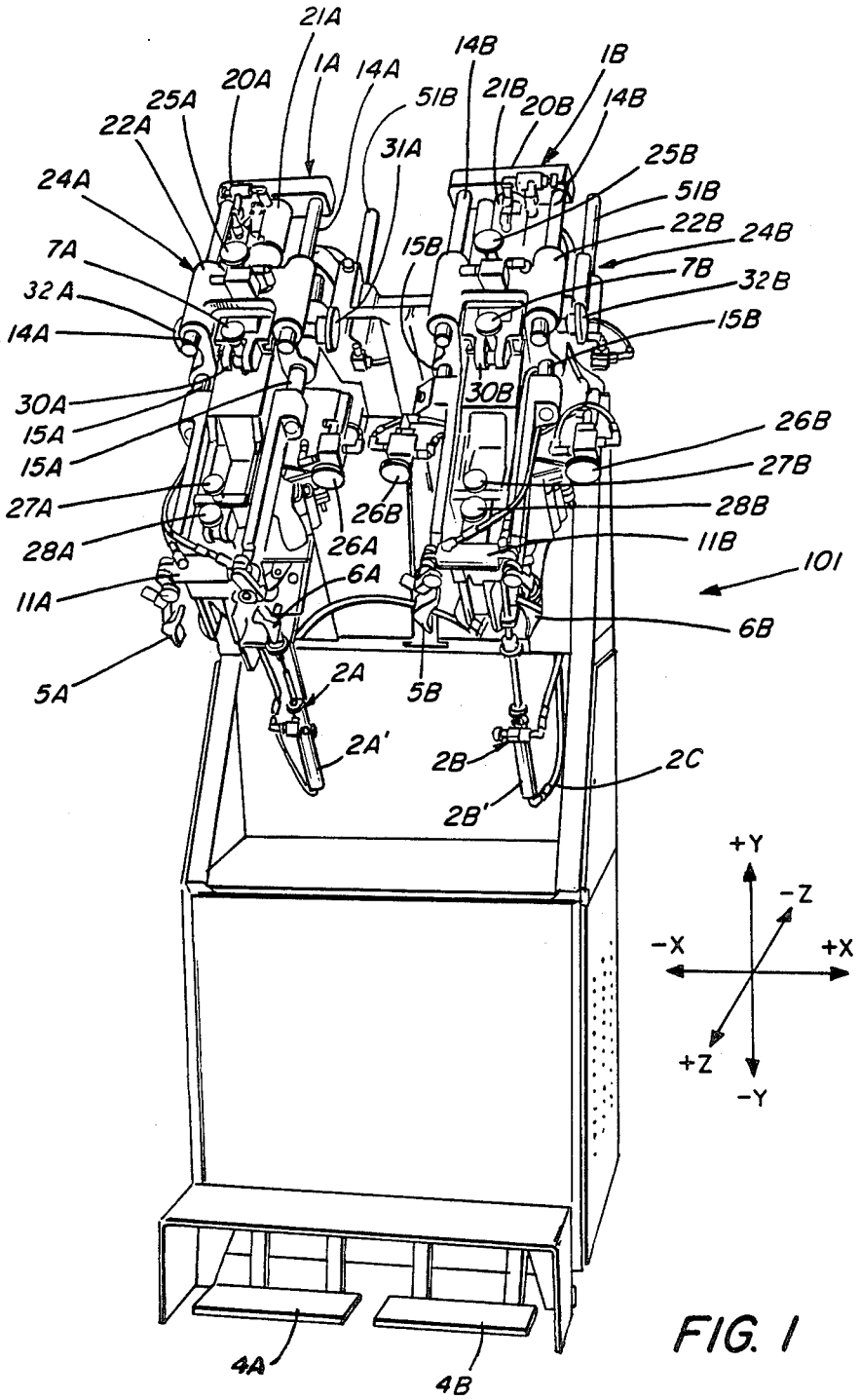
FIG. 1 is an isometric view of a heel molder flanger machine taken from a location slightly to the right front of a machine, which machine serves to mold and flange the heel of a shoe or other footwear upper.
Figure 6:
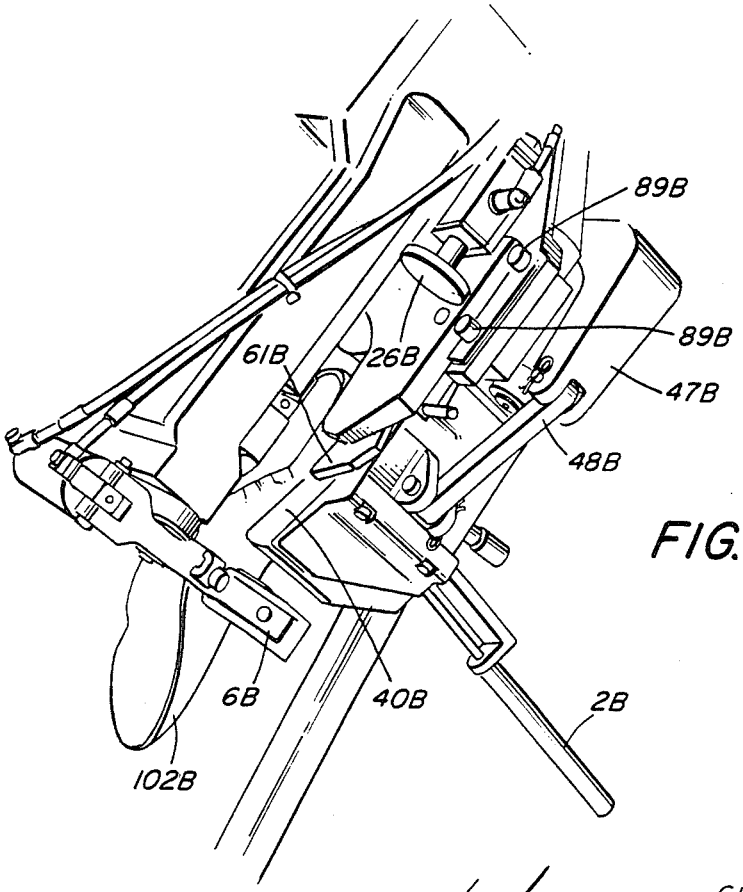
FIG 6 shows isometrically most of the parts in FIG. 5, but with wipers moved forward to wipe the heel region of the upper to achieve what is called flanging herein.
Figure 5:
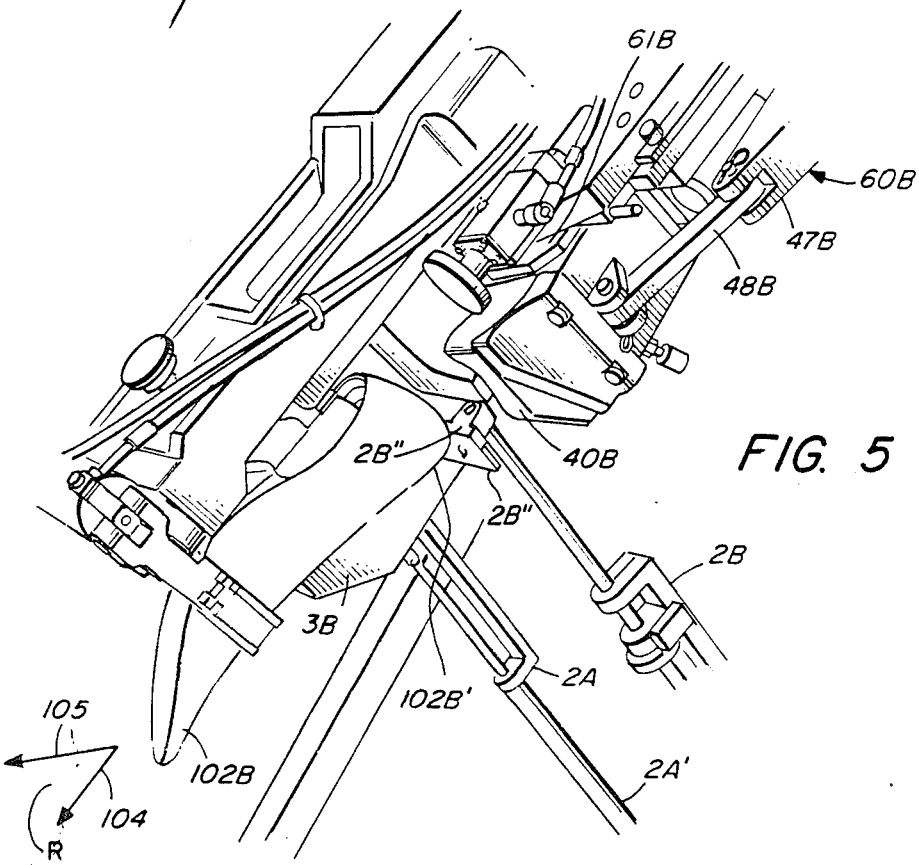
FIG. 5 is an isometric view from the right, of part of the machine of FIG. 1 to show in some detail a mold with a footwear upper thereon and a pincers mechanism to draw the upper to the left in FIG. 5.
Figure 7:
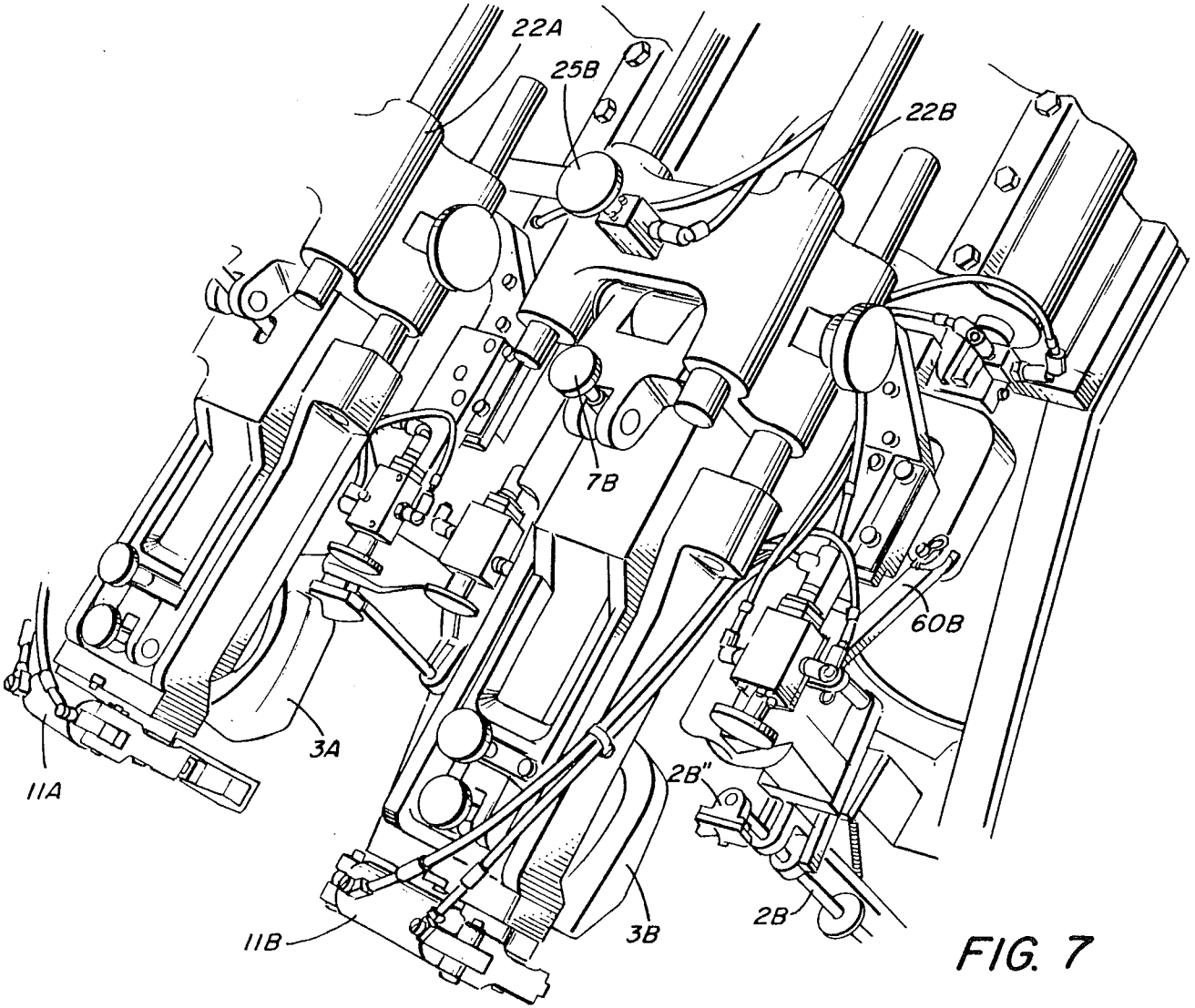
FIG. 7 is an isometric view looking down from the right at part of the machine of FIG. 1.

Turning now to FIG. 1, the machine shown at 101 is a two station, heel molder flanger machine which is adapted to receive an upper 102B in FIGS. 5 and 6 at each station of the machine 101. The two stations of the machine 101 are labeled 1A and 1B and consist of substantially identical units. In the discussion below an operating unit on the right side of the machine 101 in FIG. 1 is marked with a number and the letter "B" (e.g., an upper height gage 2B), the corresponding unit on the left side of the machine, when shown in any of the figures, being given a similar label accompanied by the letter "A" (e.g., 2A) but in parentheses. Thus the foot pedals are designated 4B (4A). While the machine 101 is capable of operating on footwear uppers generally, it is described below in the context of shoe uppers.

The machine operator is intended to stand facing the machine 101 (i.e., looking in the minus Z-direction in FIG. 1). Machine parts closest to the operator are considered to be at the front of the machine and machine parts furthest from the operator are considered to be at the back of the machine. Parts moving toward the operator are considered to have forward movement and parts moving away from the operator are considered to have rearward movement. The machine parts that make up the stations 1A and 1B move at about thirty to forty degree angle to the horizontal (the X-Z plane being horizontal), but for purposes of this explanation such movement is said to be Z-directed.

Figure 4:
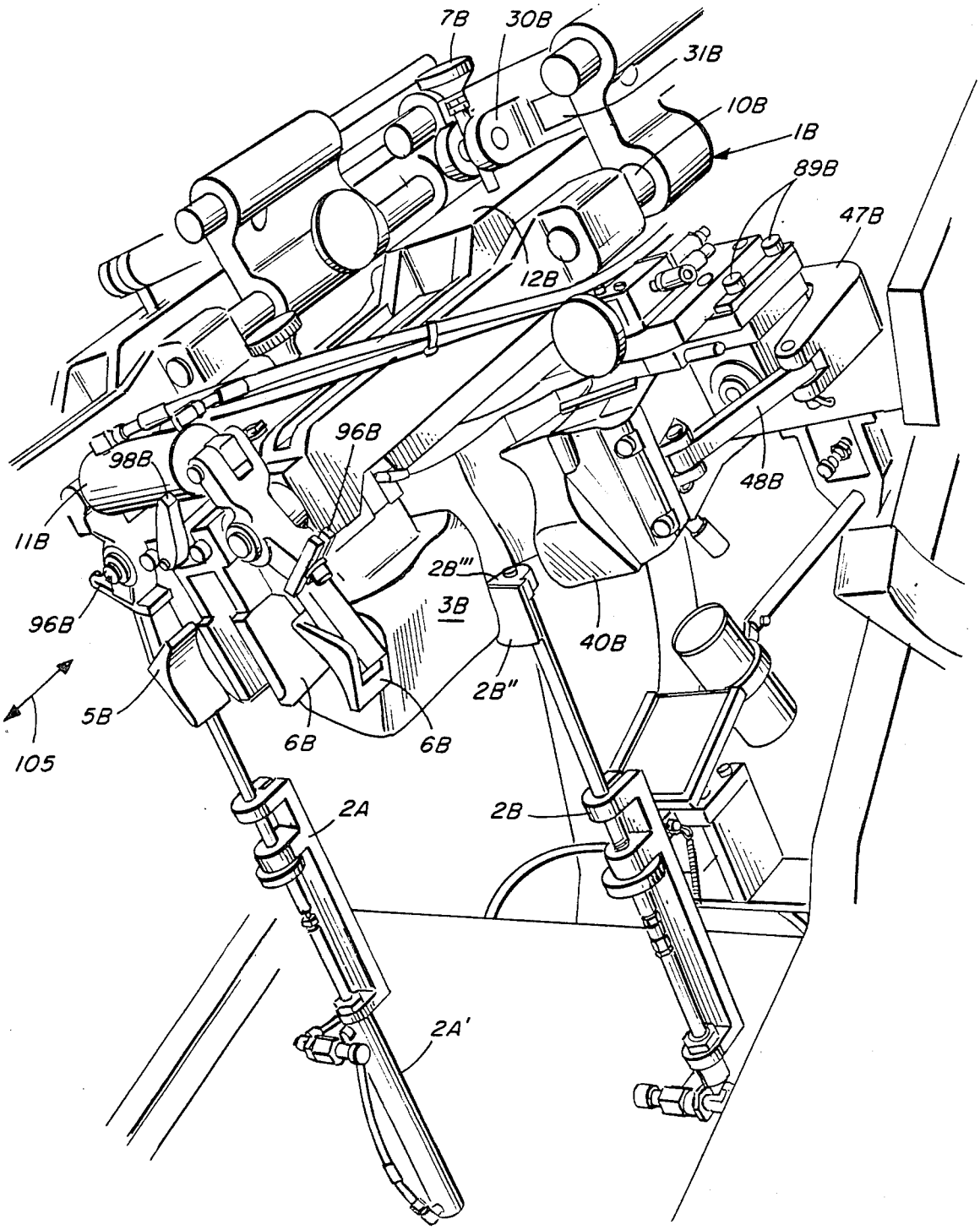
FIG. 4 is an isometric view similar to that in FIG. 3 but taken to the left of FIG. 3.
Figure 14:
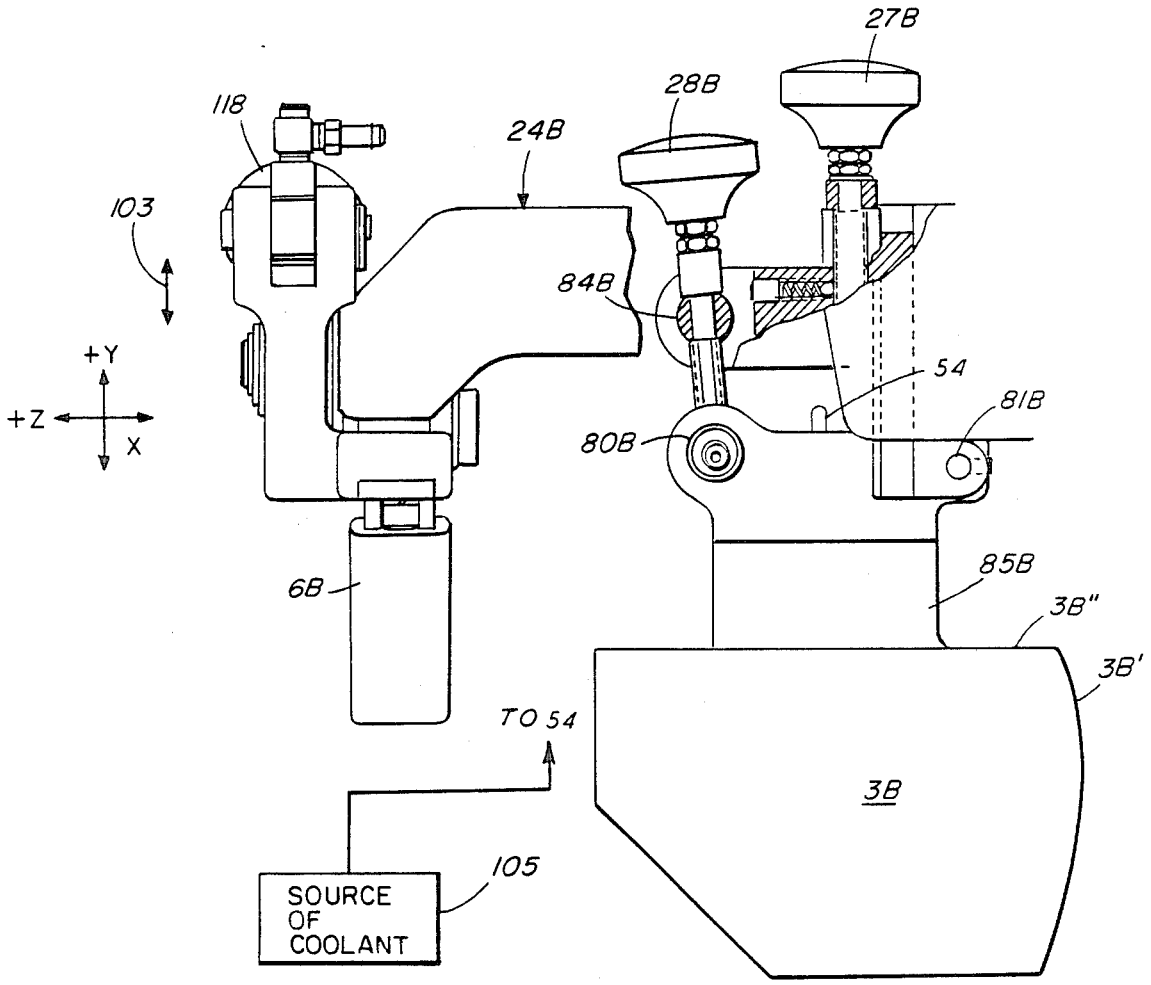
FIG. 14 is a side view, partly diagrammatic in form and cutaway, showing parts forward of the parts in FIG. 12.

The purpose of the machine 101, as above noted, is to form the heel portion of an upper substantially to the shape it will take in the finished shoe. Toward that end the upper 102B is introduced to a cooled mold 3B in FIG. 2, the coolant being freon from a source of coolant 105 in FIG. 14. At that juncture the height gage assembly marked 2B (2A) is retracted, that is, it is removed from contact with the mold 3B such that its level indicator upper contact member 2B" is spaced below and rearwardly from the mold 3B, as shown, for example, in FIG. 2. After the upper 102B is placed on the mold 3B, the height gage is moved, in a manner later discussed, to bring its level indicator (or upper contact member) 2B" into contact with the mold 3B such that the top of the level indicator determines the height level at which the top of the upper (the upper being inverted) is positioned. As will be apparent to workers in the art, the height gage thereby establishes the depth of the shoe which is ultimately formed with the upper as part thereof. The ball portion of the upper is placed within the open jaws of pincers 5B (5A) and 6B (6A) which are closed by an air cylinder 11B (11A) through articulated mechanisms shown in several of figures, including FIG. 4, and in use on machines common in the shoe industry. The operations thereafter performed are discussed hereinafter.

The pincers have a firm grasp on the forepart of the upper, typically slightly forward of the ball region of the upper. An air cylinder 21B (21A) is actuated to move an angle adjustment assembly 22B (22A) forward;

the assembly 22B (22A) is part of a larger unit 24B (24A) which acts as a rigid body that includes shafts 14B (14A), 15B (15A) and the pincers 5B (5A) and 6B (6A) as well as other interconnected parts. It is shown later, that the unit 24B pivots at 52B in FIG. 8 (the unit 24A has a similar pivot 52A) to change the angle of draw of the upper, whereby a more exact fit of the heel region of the upper about the back of the mold 3B can be achieved. In other words, the unit 24B is caused to pivot at the pivot point 52B changing the forwardly-directed angle of pull of the upper 102B with respect to its longitudinal axis, that is, the unit 24B can be rocked about the pivot point 52B, as now explained.

Figure 12:
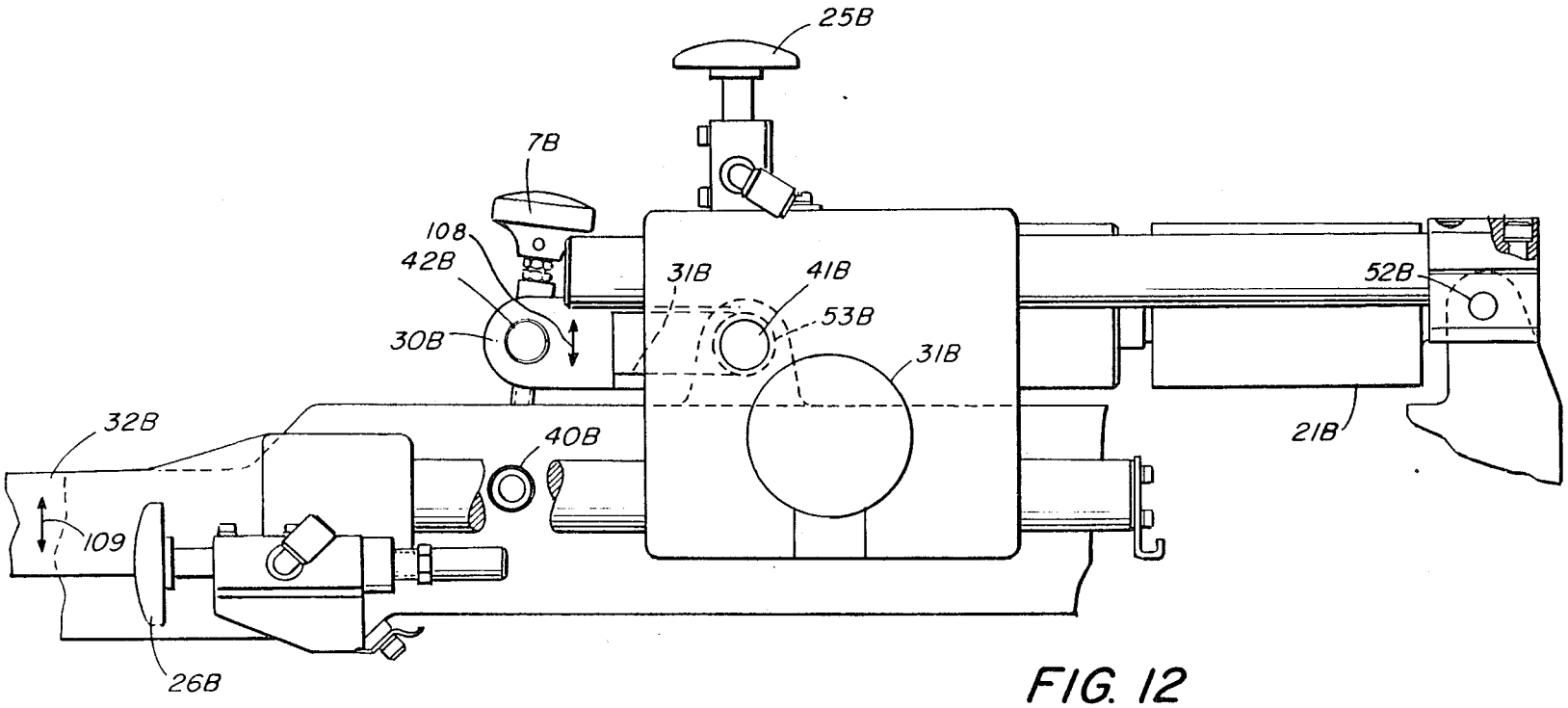
FIG. 12 is a side view showing a portion of the machine in FIG. 1.

The angle of pull exerted by the pincers 5B (5A) and 6B (6A) upon the upper is controlled separately for each side of the machine 101 by an angle adjuster 7B (7A) which affects orientation of the angle adjustment assembly 22B (22A) which, in turn, is part of the unit 24B (24A), as above noted. The actuating cylinder 21B (21A) is pivotally connected at the pivot 52B (52A) in FIG. 8 to a machine structure 59B (59A) and an end member 20B (20A) in FIGS. 1 and 8. The cylinder 21B (21A) drives the assembly 22B (22A) forward to achieve drawing of the upper about the mold, as above noted, but the drive mechanism can be tilted, as it moves forward, about the pivot 52B (52A). To achieve a change in the direction of draw, the angle adjuster 7A (7B) is threaded into an arm 30B (30A) to change the position of ways (e.g., 31B in FIGS. 4 and 12) about a pivot 41B in FIG. 12 to move the arm 30B (30A) in the direction of the arrow labeled 108 in FIG. 12 The designation 42B in FIG. 12 is a pivot between the adjuster 7B and the arm 30B. This changes the direction of travel of rollers 53B which ride on ways 31B which are in the arm 30B (30A) that can be pivoted by the angle adjuster 7B (7A). Hence, as the assembly 22B (22A) moves forward the rollers therein move along the adjustable ways (e.g., 31B in FIG. 4) which can be directed up or down through an angle indicated by the arrow 108 (FIG. 12) established by the adjuster 7B (7A). The angle of the ways 31B, etc., determines the angle movement represented by the arrow labeled 103 in FIG. 2 and the ultimate direction of draw of the upper by the pincers. Typically the direction of draw is either longitudinally along the axis of the upper or along an inclined path determined by the setting of the ways 31B, etc., through the adjuster 7B (7A). The pincers, then, move along a path established by the setting of the adjuster 7B (7A); that path has a longitudinal direction 104 in FIG. 5 and, usually, also a transverse direction, both of which are in the arrow marked 105 in FIG. 4 which is at a wide angle R in FIG. 5 from the direction 104. Once the upper 102B is stretched about mold 3B, a pad 40B (40A) of urethane or the like is moved forward as shown in FIG. 6 to wrap around the upper at the back of the mold. As is noted below, the pad 40B is actuated by a linkage 48B and an equalizer 47B which includes springs 46B which to keep the linkage 48B centered at 42B until the spring force is overcome by forces exerted upon the pad 40B. Hence, misalignment between the pad 40B and the mold 3B with an upper thereon (due, for example, to differences in upper thickness) are accommodated by the spring effect. The springs are overcome when the pad 40B is clamped.

Figure 8:
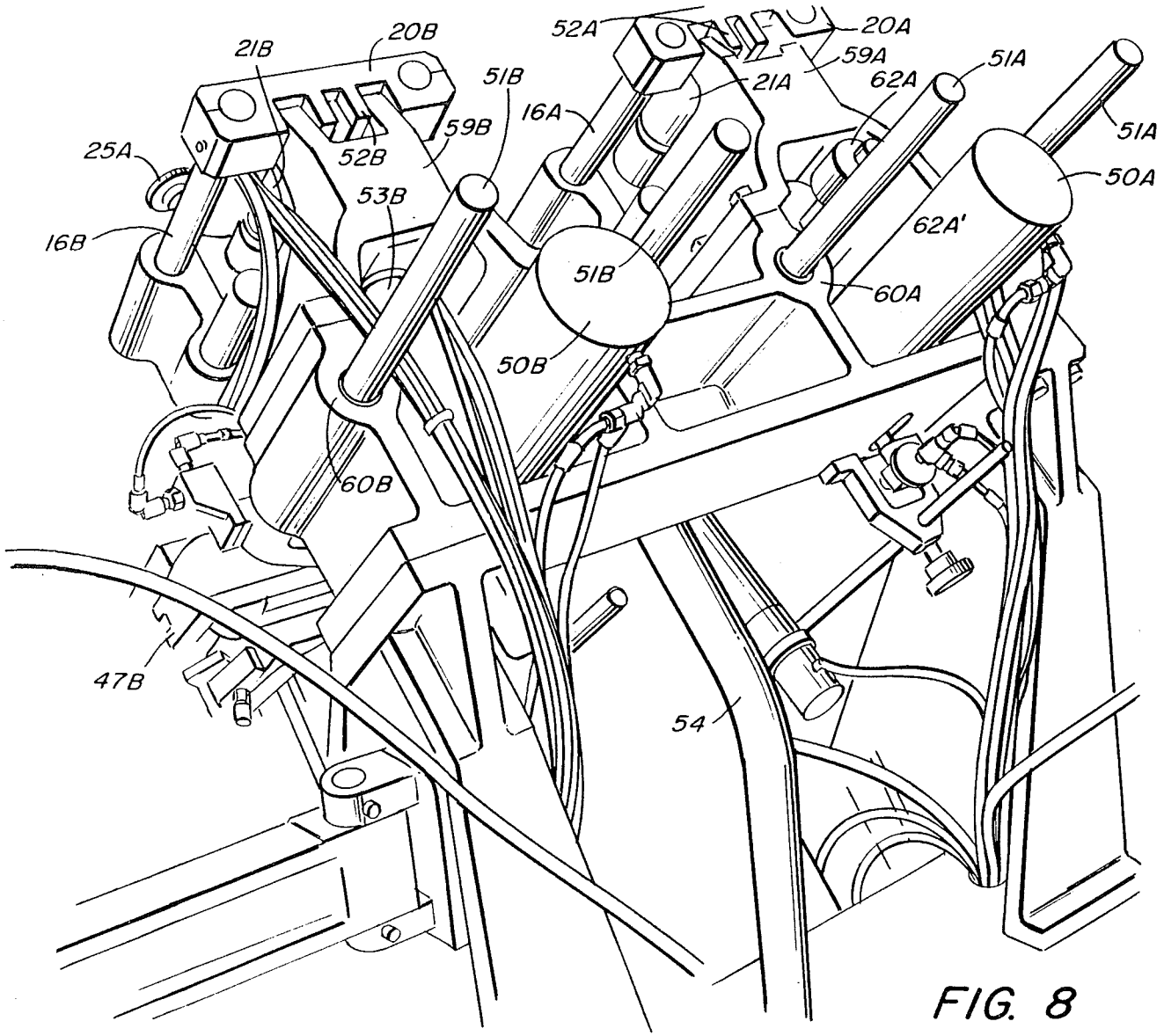
FIG. 8 is an isometric view from the left rear portion of the machine of FIG. 1 to show some operating units not shown in earlier figures.
Figure 9:
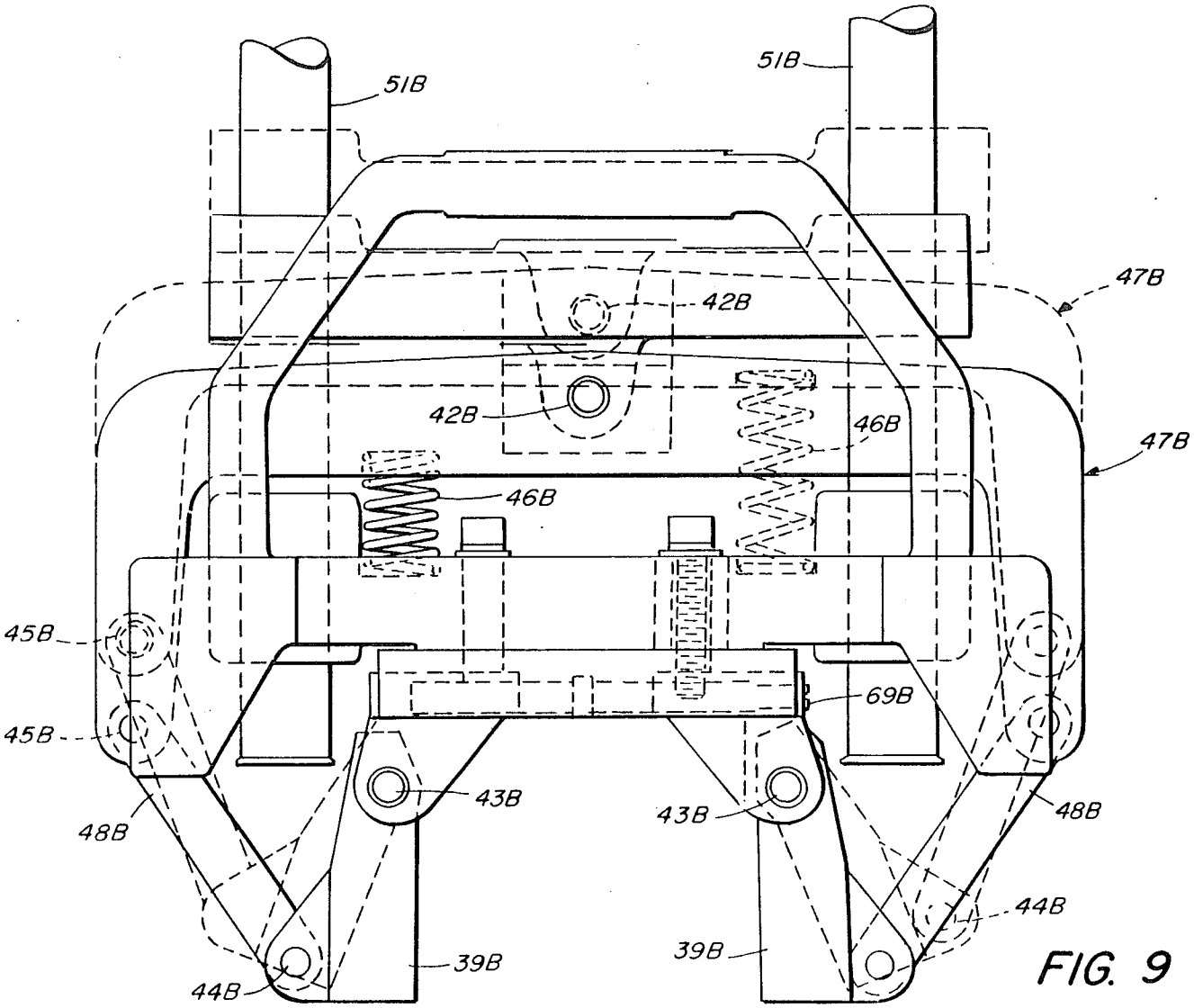
FIG. 9 shows in plan view an equalizer mechanism for a pad in the machine of FIG. 1.

Equalizing is achieved by the equalizer 47B in FIG. 9, one such equalizer being found in each of the assemblies 24B (24A) and, more particularly, in and as part of the mechanism that actuates the pad 40B (40A). The equalizer 47B and another like equalizer not shown, as it moves forward from the dotted position in FIG. 9 to the solid position, acts to move the pad 40B (40A) forward and into contact with the mold 3B (3A) and to wrap around the mold 3B (3A) or, more precisely, around the shoe upper on the respective mold. Forward movement of the pad 40B (40A) is effected by a cylinder 50B (50A) in FIG. 8 which acts through the linkage 48B (48A) in FIGS. 5, 6, and 9 to move the pad 40B (40A) forward from the spaced position in FIG. 5 to the enveloping position in FIG. 6, at which juncture wipers 61B (61A) move from the position in FIG. 5 to the wiping position in FIG. 6. As is noted above, the mold 3B (3A) is cooled, this being done by freon introduced to the machine 101 through an insulated conduit 54 in FIGS. 8 and 14. Movement of the pad 40B (40A) by the cylinder 50B (50A) is achieved along shafts 51B (51A) in FIG. 8.

The unit 24B (24A) is an important aspect of the heel molder flanger machine 101 and must be understood to comprehend how the machine 101 functions. Preliminarily it should be noted, as above discussed, that the unit 24B (24A) pivots at 52B (52A) in FIG. 8 to establish the angle of draw of the upper 102B. Simply stated, as is discussed elsewhere herein, the upper 102B is drawn or stretched about the mold 3B by a force exerted by the air cylinder 21B which is part of the unit 24B. The force is a plus Z-directed force in FIG. 1; that Z-direction force moves the casting 22B (22A) forward on shafts 16B (16A). As the casting 22B (22A) moves forward, rollers (e.g. a roller 53B at each side of the fork-shaped angle adjuster 30B in FIG. 12) associated therewith rotate about the axis 41B in FIG. 12 along ways 31B in FIGS. 4 and 12. The ways 31B are pivotally connected, also at the axis 41B, to the machine 101. Briefly, the rollers 53B are connected to the unit 24B, whereas the ways are pivotally connected at the same axis 41B to the foundation structure of the machine. Thus, as the rollers 53B in the unit 24B move forward from the axis 41B, they move along a path determined by the orientation of the ways 31B and the whole of the unit 24B swings, if it swings at all, upward in FIG. 1 to draw the upper 102B through a draw angle that has a longitudinal component (i.e., along the axis of the upper 102B) and, sometime, a transverse component (i.e., at right angles to the longitudinal component). The ratio of contribution of each component determines the angle of draw, as will be apparent to workers skilled in the art of the invention in view of the explanation herein. The unit 24B (24A) includes, in this context, the pincers 5B (5A) and 6B (6A) and related parts and, it should be evident, they all move up and down in FIG. 1 on the basis of the orientation of the ways 31B which, in turn, depends on the setting of the angle adjuster 7B (7A). The unit 24B (24A) pivots as a rigid body about the pivot 52B (52A) in FIG. 8 in response to position changes occasioned by adjustments of the adjuster 7B (7A). The pivoting, thus effectuated, determines the angle of draw of the upper 102B, that is, the pincers 5B (5A) and 6B (6A) move along a path, as the cylinder 21B (21A) forces these parts forward in FIG. 1, determined by the setting of the adjuster 7B (7A); said another way, the pincers move along a longitudinal path plus, sometime, transverse path which is determined by the adjuster 7B (7A).

It is noted above that the machine unit 24B (24A) acts as a rigid body about the pivot 52B (52A) in FIG. 8. Included in the unit 24B are the pincers 6B in FIG. 14 which move generally in the ±Y direction in FIG. 14 about the pivot 52B in FIG. 8. The knobs labeled 27B (27A) and 28B (28A) in FIG. 14 respectively adjust the ± height of the mold 3B and the tilt angle of the mold 3B about and X-axis (i.e., its transverse axis). That tilt angle also can affect the fit of the upper about the back portion (marked 3B' in FIG. 14) of the mold 3B, and the two mold adjustments permit the top, planar surface 3B" of the mold 3B to be in approximately the same plane as the plane of the wipers 61B in FIG. 2. Tilting of the mold is about a transverse axis (i.e., an X-axis).

Figure 10:
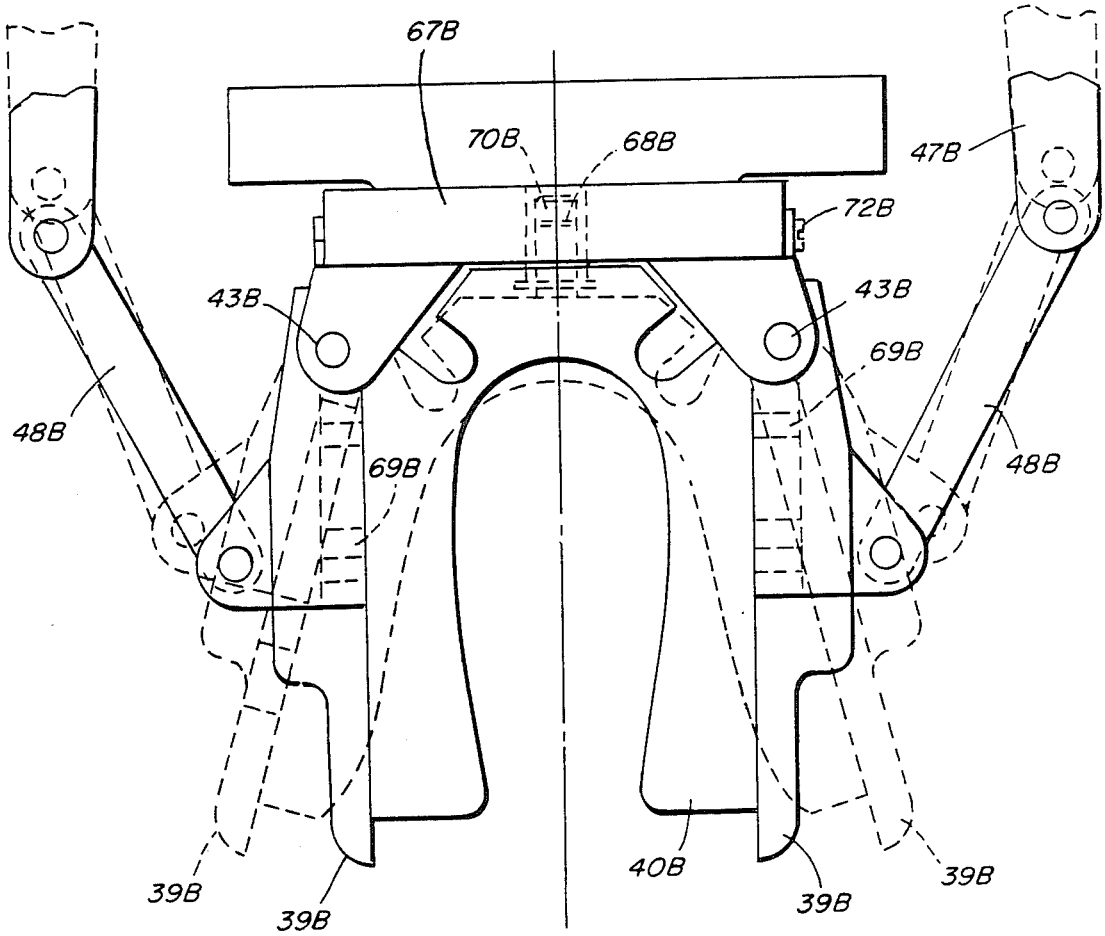
FIG. 10 shows in plan view the pad and linkages to press the pad around an upper on the mold.
Figure 11:
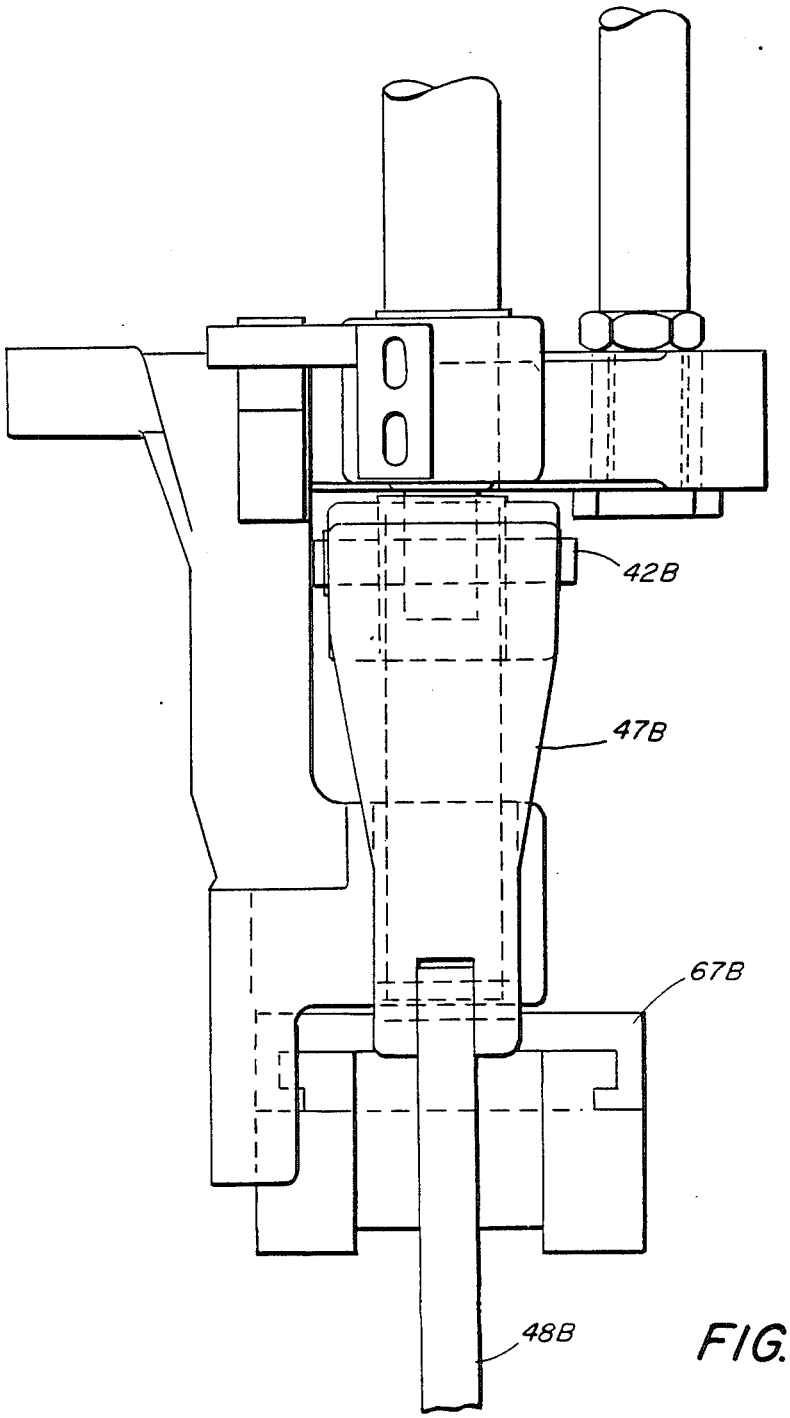
FIG. 11 is a side view of the pad linkages in FIG. 10.
Figure 13:
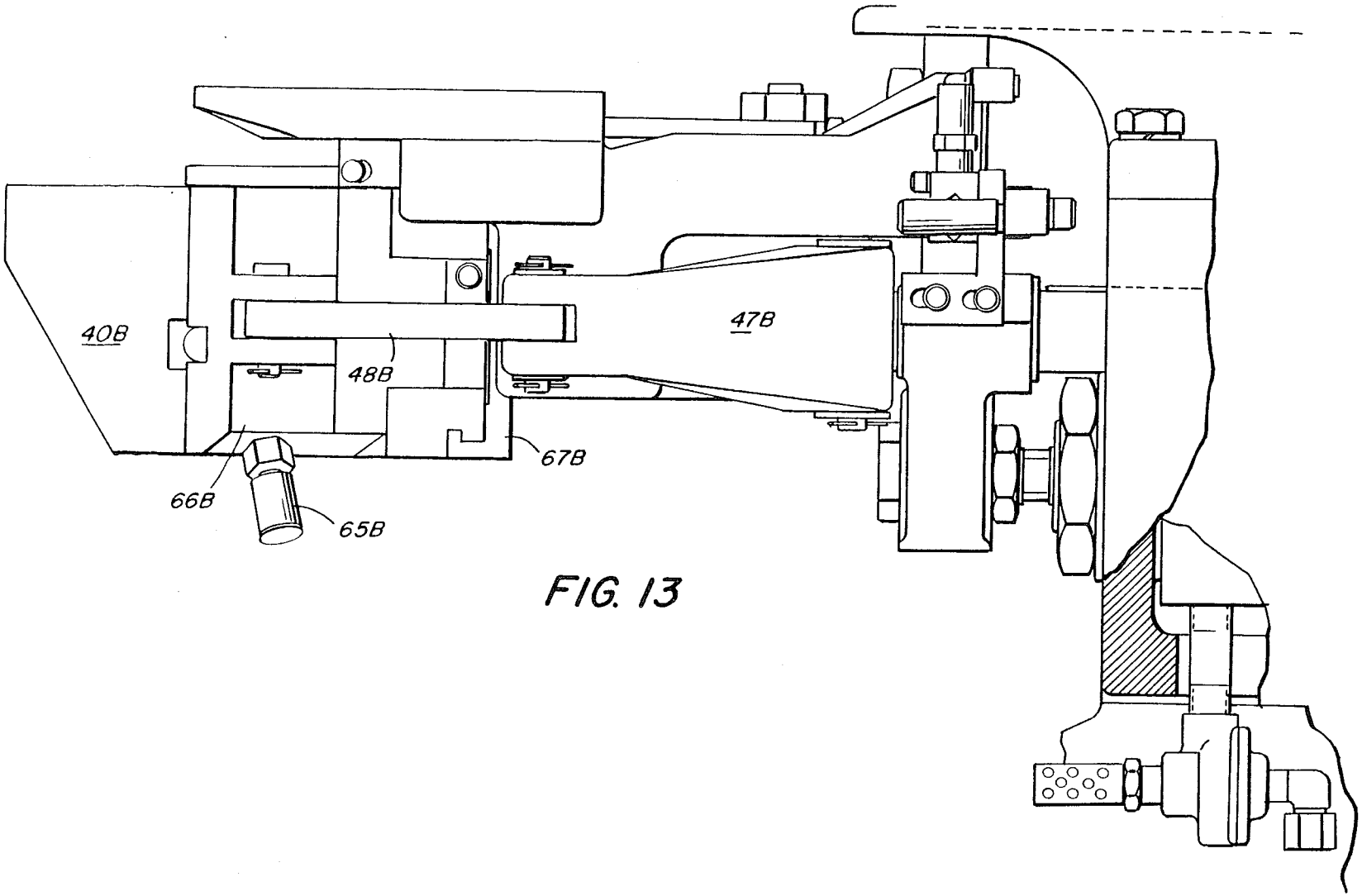
FIG. 13 is a side view of some machine parts below and forward of the parts in FIG. 12.

Quick release of the pad 40B (for changing pads to accommodate different shoe styles) in FIG. 13 is achieved by pulling outwardly a knob and shaft mechanism 65B which is received by a block 66B. The knob 65B is spring loaded and has a shaft which is received by a hole in the block 66B; the far end of the shaft is received by a detente in a metal insert 69B (FIG. 10) molded to the outer region of the mold 40B. A similar knob and shaft mechanism is found at the opposite side of the block 66B; see FIG. 10 which shows a left metal insert, but not the left knob and shaft. To remove a pad, the two knob and shaft mechanisms 65B are manually retracted to remove them from the respective detente and turned through ninety degrees to lock them in the retracted position. The pad 40B is then manually pulled forward so that a cylindrical member 68B in FIG. 10 is withdrawn from a hole 70B in the block 67B. The cylindrical member 68B serves as the third locking member of a three-member pad locking structure that further includes the knob and shaft members 65B. To install a new pad, one merely introduces its cylindrical member 68B to the hole 70B; causes the pad drive mechanism to drive the pad forward to engage the mold 3B; and releases the two knob and shaft mechanisms 65B which engage the detentes in respective metal inserts 69B in FIG. 10. In operation the pad 40B, as above noted, is driven by the linkage 48B. Specifically, the arms 39B are caused to pivot at 43B to close the pad 40B about the mold 3B. The distance between the two pivots 43B in FIG. 9 can be adjusted to bring the pivots 43B toward each other or away from each other, the adjustment serving to adjust for variations in upper thickness and/or variations in interior dimensions of the pad 40B and/or variations in the mold dimensions. Adjustment is achieved by a threaded shaft whose slotted head is shown at 72B in FIG. 10.

To form the upper 102B, it is placed on the mold 3B as shown in FIG. 5. At that instant the height gage is spaced from the mold and in the position shown in FIG. 2. The pedal 4B (4A) is depressed by the operator to energize the air cylinder 2B' (2A') in FIG. 1, raising the height gage to the position shown in FIGS. 3, 4 and 5. In the latter figure the contactor or contact member 2B" is in contact with the mold 3B and the top 102B' of the inverted upper 102B is pressed downward upon the top surface 2B"' of the contact member 2B" by the machine operator. A spring 2C in FIG. 1 maintains the contact member 2B" in pressed engagement of the mold 3B, but the spring pressure can be overcome by a small rearwardly directed force by the operator. Depression of the pedal 4B serves, also, after a slight delay, to activate the air cylinder 11B, closing the pincers 5B and 6B and, then, the air cylinder 21B is activated to stretch the upper as shown in FIG. 5. The operator then presses the two buttons 26B (26A) in FIG. 1, causing the air cylinder 50B (50A) to drive the whole pad station marked 60B (60A) forward along ways 51B (51A) in FIG. 8, thus bringing the pad 40B in contact with the heel portion of the upper 102B and then wrapping the pad 40B (by action of the linkages 48B and closely-related parts) about the upper 102B. The action of the linkages 48B is best shown in FIG. 10. Once the pad 40B is in place the pincers 5B and 6B release and after a slight delay the wipers 61B are activated by an air cylinder (like the cylinder marked 62A in FIG. 8), which air cylinder has a stroke controlled by a knob like the knob marked 62A' in FIG. 8. The margin of the upper 102B is thus wiped.

Figure 2:
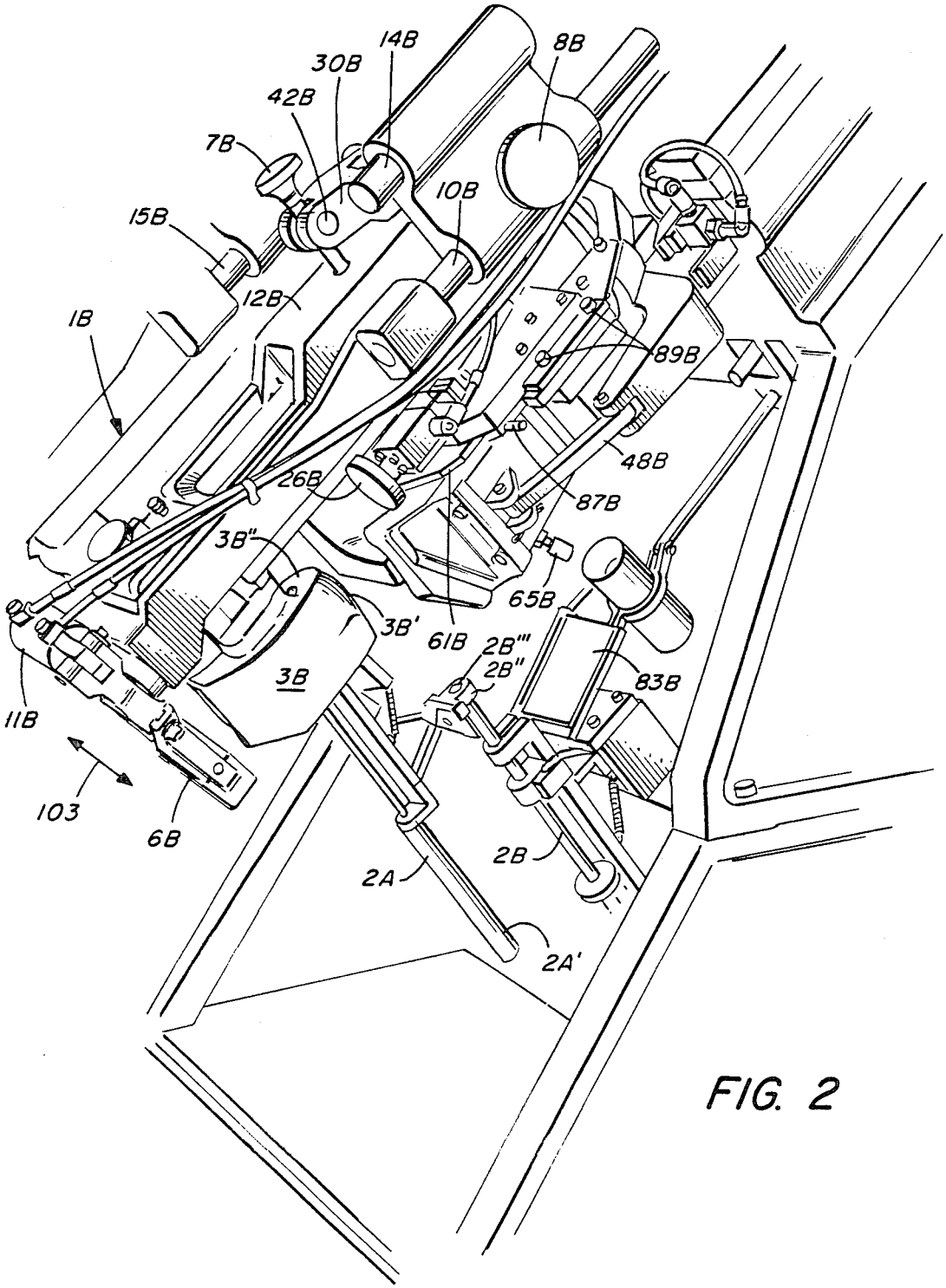
FIG. 2 is an isometric view from the right, of part of the machine in FIG. 1.
Figure 3:
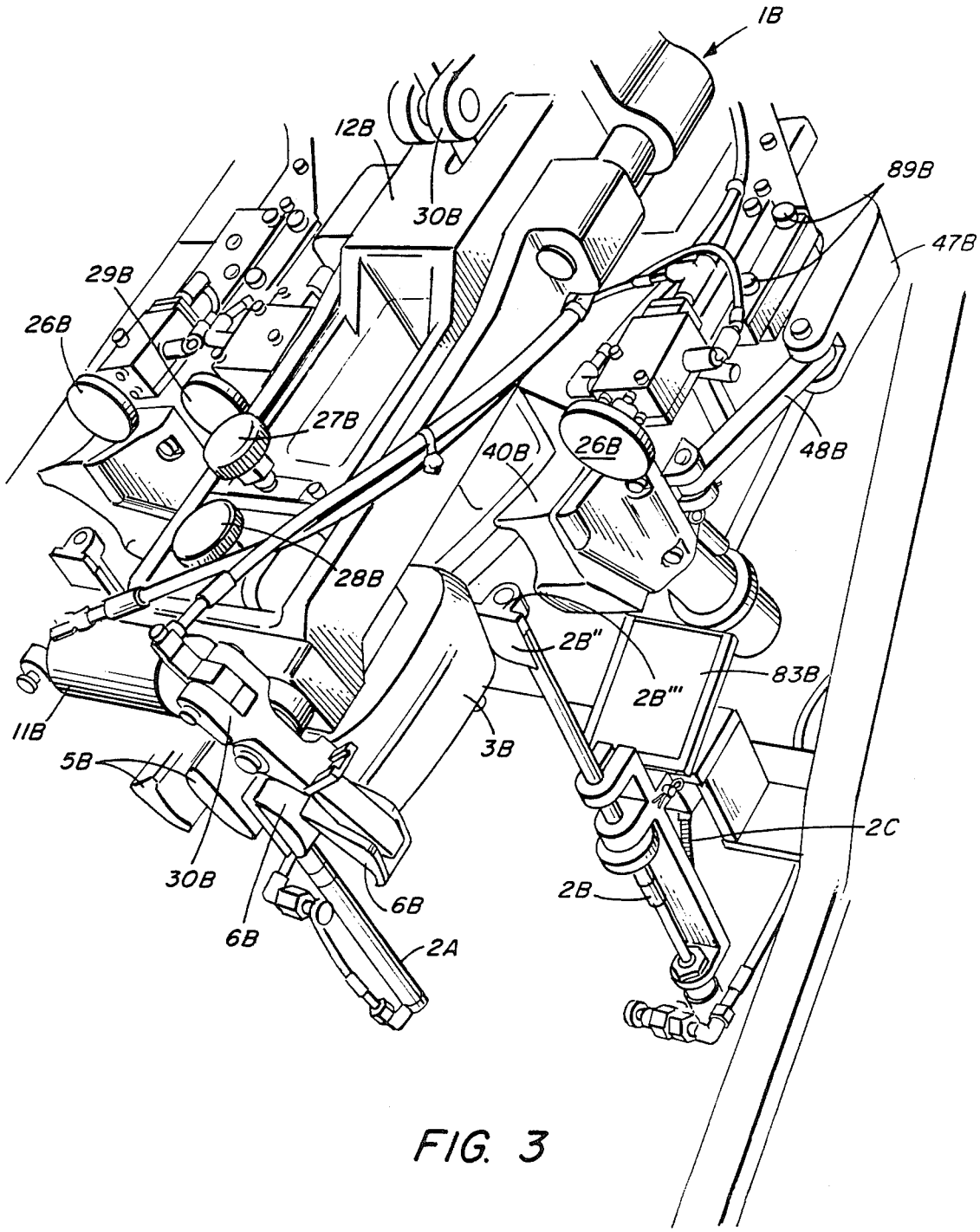
FIG. 3 is an isometric view similar to that in FIG. 2 but taken to the left of FIG. 2.

A few further matters are dealt with in this paragraph. The wipers 61B have a quick release mechanism to permit removal of the wipers from the machine 101 and installation of replacement wipers. The wipers are removed by withdrawing two spring-loaded knobs 87B (one only is shown in FIG. 2) that are like the pad knobs 65B. The screws marked 89B when loosened permit the wiper assembly to be moved longitudinally fore and aft to permit formation of welt ribbing, as well as minor adjustments to accommodate the shape of an anvil used for welt formation. The wiper stroke is controllable by knob 62A and the like in FIG. 8. The heel mold 3B in FIG. 14 has a tapered cavity to receive the chimney labeled 85B which is tapered to ease removal of the mold despite frost formed thereon by the coolant. The wedge contour gives good heat transfer and this and other aspects permits formation of a thin chimney and, hence, a thinner heel mold. The pincers 5B and 6B are easily vertically adjustable (as an assembly) by arm adjustment 98B in FIG. 4 and width adjustment is achieved by a slot and slide 96B. The labels 32A and 32B in FIG. 1 designate knobs to achieve manual longitudinal adjustment of the pincers 5B (5A) to accept various shoe sizes. The designation 83B in FIG. 3 is to one of two mirrors of the machine.

Further modifications of the invention disclosed herein will occur to persons skilled in the art and all such modifications are deemed to be within the scope of the invention as defined by the appended claims.

What is claimed is:

1. A machine to mold and flange the heel region of an upper whose heel region has been heated to soften the same, that comprises:

a mold to receive the upper;

pincers means positioned to grasp the forepart of the upper and operable to draw the upper about the mold to stretch and form the heel portion of the upper to the exterior shape of the back region of the mold;

pincers drive means to drive the pincers means to achieve drawing of the upper;

a pad having an interior contour shaped to the exterior shape of the mold; and means to drive the pad from a position spaced from the mold to a position in intimate contact with the heel portion of the upper to squeeze the heel region of the upper between the pad and the mold, which means to drive the pad includes an equalizer mechanism whereby the pad adjusts in order to apply substantially uniform inward pressure at all points between the pad and the mold, said equalizer means including adjustable pad pivots, adjustment thereof serving to adjust for variations in upper thickness and/or variations in interior contour of the pad and/or variations in the contour of the mold.

2. A machine according to claim 1 that further includes wipers means which, once the pad is pressed against and in intimate contact with the upper, effects wiping of the upper.

3. A machine according to claim 2 wherein the wiper means includes a pair of wipers and means to drive the wipers to achieve wiping.

4. A machine according to claim 3 that includes means to cool the mold to effect rapid cooling of the heel region of the upper which, once it is wiped, maintains its wiped shape.

5. A machine according to claim 1 in which the pincers means draw the upper in a direction having a longitudinal component of stretch and in which the pincers drive is adjustable to change said direction such that a transverse component of stretch is included, whereby conformance of the heel region of the upper to the back of the mold can be controllably achieved.

6. A machine according to claim 5 in which the pincers means comprises a pair of pincers and in which the pincers drive means includes an air cylinder and a drive mechanism connecting the air cylinder to the pincers, whereby the air cylinder, when activated, drives the pair pincers in a direction having a longitudinal component.

7. A machine according to claim 6 that includes a height gage to assure proper vertical positioning of the upper with respect to the mold.

8. A machine according to claim 1 having a quick release mechanism to permit removal of the pad from the machine and installation of a replacement pad.

9. A machine according to claim 1 having a quick release mechanism to permit removal of the wipers from the machine and installation of replacement wipers.

10. A machine according to claim 1 in which the mold is tiltable about its transverse axis.

11. A machine according to claim 1 which includes wiper means to flange the upper, which wiper means is adapted to permit quick change of the wipers.

12. A machine to mold and flange the heel region of an upper whose heel region has been heated to soften the same, that comprises:

a mold to receive the upper;

pincers means positioned to grasp the forepart of the upper and operable to draw the upper about the mold to stretch and form the heel portion of the upper to the exterior shape of the back region of the mold;

pincers drive means to drive the pincers means to achieve drawing of the upper;

a pad having an interior contour shaped to the exterior shape of the mold;

means to drive the pad from a position spaced from the mold to a position in intimate contact with the heel portion of the upper to squeeze the heel region of the upper between the pad and the mold, which means to drive the pad includes an equalizer mechanism whereby the pad adjusts in order to apply substantially uniform inward pressure at all points between the pad and the mold; and a spring-loaded height gage to assure proper vertical positioning of the upper with respect to the mold, which height gage has a contactor to assure proper height and alignment of the upper on the mold and which has means to move the height gage from a location wherein the contactor is spaced from the mold to a location wherein the contactor is in spring-loaded contact with the mold to assure appropiate height of the upper relative to the mold.

13. A machine according to claim 12 which the height gage comprises a shaft at whose free end the contactor is located and whose other end is interconnected to an air cylinder, said air cylinder being operable respectively to bring the contactor into contact with the mold and to remove the contactor or contact member from such contact.

14. A machine according to claim 13 in which the height gage includes a spring operable to press the upper contact member toward the mold but adapted to permit the upper contact member to be forced away from the mold.

15. A machine to mold and flange the heel region of an upper whose heel region has been heated to soften the same, which machine comprises:

a cooled mold to receive the upper;

pincers means positioned to grasp the forepart of the upper and operable to draw the upper about the mold to stretch and form the upper;

means to drive the pincers means to achieve drawing of the upper;

a pad having an interior contour shaped to the exterior contour of the male mold positioned to receive the male mold;

a height gage adapted to permit installation of the upper upon the mold, whereby the vertical position of the upper with respect to the mold is established by the height gage; and adustable pad pivots, adjustment thereof serving to adjust for variations in upper thickness and/or variations in interior dimensions of the pad and/or variations in the dimensions of the mold.

16. A method of molding and flanging the heel region or portion of a footwear upper that includes a material that is flaccid above room temperature but is relatively rigid at room temperature, which method comprises:

stretching the heel region or portion about a mold shaped to the contour of the heel region or portion while simultaneously withdrawing heat energy from the heel portion or region;

providing a height gaging device to assure proper vertical positioning of the upper with respect to the mold, said height gaging device being movable from a spaced position relative to the mold to a position wherein it is in spring-loaded contact with the mold, the spring loading serving to permit the height gaging device to be moved to permit the upper to be mounted on the mold; and flanging the margin of the upper at the heel region or portion.

17. A machine to mold and flange the heel region of an upper whose heel region has been heated to soften the same, which machine comprises:

a cooled mold to receive the upper;

pincers means positioned to grasp the forepart of the upper and operable to draw the upper about the mold to stretch and form the upper;

means to drive the pincers means to achieve drawing of the upper;

a pad having an interior contour shaped to the exterior contour of the mold to receive the mold with the upper thereon; and means to adjust the position of the pad to correct for variations in the upper thickness and/or variations in the interior dimensions of the pad and/or variations in the dimensions of the mold.

18. A method of forming the heel region or portion of a footwear upper, that comprises:

stretching the heel region or portion about a mold shaped at the area of contact between the heel region or portion and the mold to the contour of the heel region or portion;

moving a pad having an interior contact shaped substantially to the outer contour of the mold into intimate engagement of the footwear upper to press the footwear upper about the mold; and adjusting the position of the pad to adjust for variations in upper thickness and/or variations in interior contour of the pad and/or variations in the outer contour of the mold;

thereby forming the heel region or portion of the footwear upper to said outer contour of the mold.

* * * * *